United States Patent [19]

Garrett

[11] 4,057,293

[45] Nov. 8, 1977

[54] PROCESS FOR IN SITU CONVERSION OF COAL OR THE LIKE INTO OIL AND GAS

[76] Inventor: Donald E. Garrett, 505 W. 9th St., Claremont, Calif. 91711

[21] Appl. No.: 704,236

[22] Filed: July 12, 1976

[51] Int. Cl.[2] ..... E21C 41/00

[52] U.S. Cl. ..... 299/2; 48/DIG. 6; 166/259; 166/261; 166/263

[58] Field of Search ..... 299/2; 166/256, 259, 166/261, 263; 48/DIG. 6

[56] References Cited

U.S. PATENT DOCUMENTS

| | | | |
|---|---|---|---|
| 947,608 | 1/1910 | Betts | 299/2 |
| 3,734,180 | 5/1973 | Rhoades | 166/261 X |
| 3,734,184 | 5/1973 | Scott | 166/261 X |
| 3,980,339 | 9/1976 | Heald et al. | 299/2 |

*Primary Examiner*—Ernest R. Purser

[57] ABSTRACT

This application discloses a process for accomplishing in situ retorting of coal, or a similar hydrocarbon by constructing a substantially impervious retorting area, and then fragmenting the coal to provide a substantially homogeneous, porous mass. After pyrolysis due to the introduction of oxygen-containing gas at one portion and withdrawal of oil and gas at another portion, the direction of gas flow is reversed to convert the char into a relatively high B.T.U. gas product.

15 Claims, No Drawings

PROCESS FOR IN SITU CONVERSION OF COAL OR THE LIKE INTO OIL AND GAS

BACKGROUND OF THE INVENTION

This invention relates to the conversion of coal, and similar porous hydrocarbons, into other, more readily usable, hydrocarbon products, specifically oil and gas. More particularly, the present invention relates to an in situ process for such conversion.

There have been numerous efforts in this general field of in situ hydrocarbon conversion, as reflected by the prior art. For example, U.S. Pat. No. 3,316,020 to Bergstrom discloses an in situ oil shale recovery process in which an impervious wall is constructed around a selected retort space, explosives are used to fragment the oil shale, a combustion-supporting fluid (air) is introduced into the space to volatilize the oil shale rubble, and the volatilized oil and gas product is removed, and processed to recover hydrocarbon fuels in liquid and gas states. U.S. Pat. No. 1,269,747 to Rogers discloses a similar process. U.S. Pat. No. 3,566,377 to Ellington discloses an in situ process for retorting oil shale wherein several areas are retorted in series, and the hot flue gases from one area are passed into the next area to preheat the rubble.

The above prior art in situ retorting processes for oil shale have a number of critical deficiencies. These prior art processes are not economical in that they are expensive and result in a low yield of very low B.T.U. gas products, and they are difficult to control. All of the prior art in situ retorting of coal has been commercially unsuccessful, produced a highly variable, very low B.T.U. gas, had low yields, and been difficult, if not impossible, to control, as well as requiring very specific coal seams. As a result, no reliable process of in situ gasification of coal or similar porous hydrocarbons to yield a high B.T.U. gas has been heretofore known.

The in situ retorting of coal and similar hydrocarbons poses an even more difficult problem than with oil shale because the former materials may be porous and have many fracture paths through them making control even more difficult.

SUMMARY OF THE INVENTION

This invention accomplishes the in situ retorting of coal to obtain a relatively high B.T.U. gas product by including these significant process steps:

a. The coal retort areas are enclosed by substantially impervious wall structures to prevent any substantial gas leakage;
b. The coal in each retort area is fragmented by extensive blasting to provide a substantially homogeneous rubble;
c. Oxygen-containing gas is introduced in one portion of the retort area to burn a small amount of the coal to initiate pyrolysis on the mass of coal, and oil and gas products are withdrawn at another portion of the retort area; and
d. When pyrolysis is substantially completed, the gas flow is reversed so that the residual coal produces a relatively high B.T.U. gas or oil product.

DESCRIPTION OF THE PREFERRED PROCESS

The first major step is to form a suitable enclosed retort area within the coal deposit. The simplest approach is to work with an abandoned coal mine. Here a room is first prepared by building membrane walls around the periphery of an area, or in the tunnels and drifts surrounding the area. These may be of a masonry type in which local rock or block are used for the wall structure. They may be a double wall with rock or gob pile material filled in between, or merely rock or gob pile material piled up against one wall and then gunited or similarly filled in to make a substantially impervious membrane. Since the roof will later be caving on the remainder of the deposit, the wall must be strong enough to maintain its impermeability after partial roof collapse. Rock, or like material, may be placed in the room to help support the roof.

In a new mining operation, the passage ways would be made solely for the purpose of constructing the containing walls or providing void space within the deposit. The operation is preferably started in a back corner of an ore body so that the gasification may proceed toward the point of withdrawal (although it could be started anywhere). The operation should proceed, chamber after chamber, in a row until all of the back boundary has been worked, and then a new row should be started.

The exterior wall of the retorting rooms should be constructed rather substantially since they not only need to support the roof and allow the safe passage of operators to check on the equipment behind them but they also need to remain gas tight throughout the life of the operation. They are preferably a double gunited or masonry wall filled with rock or rubble. The wall also must be able to withstand the high temperatures within the retorting area and not leak. With a double wall, if the first one makes a fairly leakfree contact with the upper and lower strata in the deposit, it will absorb much of the heat; and the rubble filled zone between walls will act as an insulator, so that the outside wall can be grouted and sealed with more flexible and better sealing material.

The dimensions of the room may be essentially any size, but for moderately thin seams in the order of 1–10 feet in height, rooms 400 to 500 ft. in length and 100 to 200 ft. in width are probably the most appropriate. Obviously, the larger the rooms are, the fewer rooms are needed for a given operation; and the preparation and wall forming costs are less. However, the larger the rooms are, the more chance there will be for uneven flow conditions and for bypassing a portion of the ore.

The coal seam thickness that can be operated will strictly depend upon the economics involved, but in general, any seam thicker than 2 feet or so may be employed. Alternatively and preferably for thicker seams, a different wall construction may be used, such as packing rubble and covering it on both sides with screens that are gunited to make an impervious membrane, then tying the structure into an adjacent standing coal wall with roof bolts, or similar simple construction. This can be done as the membrane wall area is being mined out.

The second major step is to blast the existing coal pillars in the room to make as nearly uniform a mass of coal as possible in the room itself. Since the area of pillars is generally only 40% or so of that mined, it can be seen that a great deal of fill can be added to the room and still allow these pillars to be blasted to make a mass that is permeable for gases to flow through. The porosity limit should be 5 to 40%, and ideally the porosity should be somewhere in the 20 to 25% range.

In the preparation of the room for retorting, explosive charges should be placed in the ore body (or the coal pillars) so that it will be blasted in as uniform and homogeneous manner as possible and fill the entire room. If desired, some pillars may be left to continue their function as a roof support, or other roof support may be added such as rock fill, etc. Similarly, in working with a new coal deposit, the blasting may be made to take place so that pillars are purposely left in the room for roof support while the rest of the room is blasted into the form of rubble desired by this process.

This step of converting the coal to a porous rubble having a substantially uniform void space is very important, because it is necessary for the successful controlling of the subsequent pyrolizing step. In other words, adequate preparation of the rubbleized mass of coal is necessary for easy gas contact and for control of the combustion cycle.

The third major step is the retorting of the rubbleized coal mass within the enclosed retorting area. This uses a partial burning to create sufficient heat to accomplish pyrolysis of the solid hydrocarbons into liquid and gas states, in which states they are easily recovered from the mined area.

Air or oxygen is fed to the enclosed retort room all along one face in a slow and controlled manner, the ore is ignited; and the flue gas and oil are withdrawn from the opposite end of the room. The flue gas will leave at essentially the ambient rock temperature (or comparatively cold) until the flame or retorting front approaches the exit wall. At that time a fairly rapid rise in temperature will occur. In the case of retorting coal, there is so much residual carbon left behind after the volatiles have been removed that the flame front will not move very far from the front wall as all of the room is slowly being heated up to first pyrolysis, and then combustion temperature. In the pyrolysis and combustion zones temperatures of 900° to 2500° F can be allowed. The normal volatilizing temperature is in the range of 900° to 1000° F. If oxygen is being used for combustion, sufficient steam or water should be added with the oxygen to maintain a comparatively low temperature flame front, optimized at about 1600–2000° F for the water-gas reaction, and the coal will be consumed at a speed proportional to the advance of the retorting front. The flue gas will be a relatively high B.T.U. product. If, however, air is used with the fuel the entire room will be volatilized before the flame has moved very far from the front wall. Oil will be the initial major product, along with a low but usable B.T.U. flue gas. In either case, it is preferred that once the exiting flue gases begin to rise in temperature, they be diverted into an adjacent retort in order to allow their heating value to be fully utilized before they are sent to the surface for further use.

The high permeability of the ore mass that has been formed in the room will result in a comparatively low pressure drop for the air or oxygen flow through the blasted, rubbleized mass. This is highly advantageous since the walls cannot withstand very much pressure without leaking, and consequently, it is preferred that a combination of low pressure on the outlet side be employed to minimize leakage. If the room inadvertently leaks and it cannot be corrected, the entire flow should be caused by vacuum withdrawal, since this will cause all leakage to be into the room rather than flue gases escaping from it.

The critical fourth step in this process is a flow reversal step. When the temperature has risen to a high value (i.e., about 900°–1200° F) on the outlet or flue gas side, the flow is reversed, and the steam alone (or steam plus some air, if ammonia plant synthesis gas is to be produced) is introduced into the former flue gas withdrawal side. After the bulk of the nitrogen-containing residual vapors are swept from the system, a relatively high B.T.U. gas is produced, and removed from the former entry side of the system, until the temperature drops to below the rapid-water-gas-reaction temperature, or about 1400° F. The cycle is then repeated, by introducing air in the original direction.

Thus, to avoid the expense of an oxygen plant, and where some low B.T.U. gas, or some nitrogen content, can be utilized, a reversing cycle air-steam system can be employed. In this system, preferably for the highest yield of relatively high B.T.U. gas, after a room has been volatilized, air is blown through it until the exit flue gas temperature rises to some value near where the water-gas reaction will take place. This may be as low as 1000° F if there is an uneven flame front, or gas flow, coming through the retort, but preferably should be about 1400° F. The air is then cut off, and the steam flow initiated into the opposite, or former flue gas, end. Once the nitrogen-containing gas within the chamber is displaced, a relatively high B.T.U. gas is produced until the temperature of the exit gas drops below 1200° to 1400° F. This hot, relatively high B.T.U. gas is an excellent heat source to retort a fresh chamber until volatilization is complete.

If the coal gasification operation is supplying gas for an ammonia plant or other operation where the highest B.T.U. gas is not necessary, or where some nitrogen content of the gas is either desired or acceptable, then various options would be open. First, the flue gas from the air combustion cycle will have a low, but recoverable, B.T.U. content of from 40 to 100 B.T.U./M cubic feet. This can normally be used in special low B.T.U. turbines, for steam generation, or for process heat, all uses benefiting by excellent heat exchange of the inlet gas and air with the flue gases. If desired, this gas could also be blended with the much higher B.T.U. gas from the steam cycle. Also, the purge gas from both steam replacing air, and vice versa, will be of an intermediate B.T.U. content, and can be used for blending. Finally, if the retort is not too tight, and vacuum is used, pulling in considerable nitrogen with the air, this may supply as much nitrogen as is desired, and no further blending would be required.

The following claims are intended to cover all variations and modifications of the herein described process which come within the scope of the inventive concepts incorporated in this application.

I claim:

1. A process for the in situ gasification of coal, or similar hydrocarbon solid, by means of a reversing cycle oxygen-steam system, the process comprising the steps of:

a. forming at least one retorting room in a coal deposit by segregating an area from surrounding areas by means of substantially impervious walls to prevent substantial gas leakage from said retorting room, said retorting room having a roof defined by the coal deposit and further having a gas inlet passage and a gas outlet passage;

b. blasting within said retorting room to effect at least a partial roof collapse to form a substantially homogeneous, porous rubblized coal mass in said retorting room;

c. introducing oxygen-containing gas in said gas inlet passage of the retorting room and initiating and conducting pyrolysis of the coal mass at a temperature of between about 900° and about 2500° F.;

d. withdrawing oil and gas products from the pyrolysis through said gas outlet passage of the retorting room;

e. after substantial completion of the pyrolysis conducted in step (c) and product withdrawal from step (d), reversing the direction of gas flow through the retorting room by introducing steam into said gas outlet passage thereby to effect a water-gas reaction with residual carbon in said retorting room to produce a relatively high BTU gas product and f. withdrawing said relatively high BTU gas product from the water-gas reaction through said gas inlet passage of the retorting room.

2. The process of claim 1 wherein the withdrawn gas is utilized to preheat another segregated retorting room.

3. The process of claim 1 wherein the flow of gas through the retorting room is primarily by vacuum on the withdrawal end.

4. The process of claim 1 wherein the reverse gas flow is initiated when the temperature in the retort is in the approximate range of 1200° to 1400° F.

5. The process of claim 1 wherein the porosity of said rubblized coal mass is not less than 5%.

6. The process of claim 1 wherein the porosity of said rubblized coal mass is between approximately 15 and 25%.

7. The process of claim 1 wherein the coal pillars of a previously mined coal mine are used for forming said rubblized coal mass.

8. The process of claim 7 wherein said substantially impervious membrane walls are formed by packing rubble with overlying screens which are gunited and secured to the existing coal walls of said previously mined coal mine.

9. A process for the in situ gasification of coal or similar hydrocarbon solid, by means of a reversing cycle oxygen-steam system, the process including the steps of:

a. forming at least one retorting room in a coal deposit by segregating an area from surrounding areas by means of substantially impervious membrane walls to prevent substantial gas leakage from said retorting room, said membrane walls comprising a double wall structure having a zone between said walls, the zone filled with gob pile material, and said retorting room having a roof defined by the coal deposit and further having a gas inlet passage and a gas outlet passage;

b. blasting within said retorting room to effect at least a partial roof collapse to form a substantially homogeneous, porous rubblized coal mass in said retorting room;

c. introducing oxygen-containing gas in said gas inlet passage of the retorting room and initiating and conducting pyrolysis of the coal mass at a temperature of between about 900° and about 2500° F.;

d. withdrawing oil and gas products from the pyrolysis through said gas outlet passage of the retorting room;

e. after substantial completion of the pyrolysis conducted in step (c) and product withdrawal in step (d), reversing the direction of gas flow through the retorting room when the temperature of said gas product withdrawn has attained a temperature of between about 900° and about 1200° F. by introducing steam into said gas outlet passage thereby to sweep nitrogen-containing residual vapors from the room, and to effect a water-gas reaction with residual carbon in said retorting room to produce a relatively high BTU gas product; and f. withdrawing the relatively high BTU gas product from the water-gas reaction through said gas inlet passage of the retorting room.

10. The process of claim 9 wherein the dimensions of the retorting room is from about 400 feet to about 500 feet in length and about 100 feet to about 200 feet in width.

11. The process of claim 9 wherein said oxygen-containing gas consists essentially of oxygen and water vapor.

12. The process of claim 9 wherein said step of withdrawing gas products from the pyrolysis is effected by a vacuum means applied to said gas outlet passage.

13. The process of claim 9 and further comprising the steps of repeating the cycle described in steps (c) through (f) by introducing a new supply of oxygen-containing gas in said gas inlet passage of the retorting room upon completion of said withdrawing the relatively high BTU gas product.

14. The process of claim 9 wherein said retorting room is formed in a previously mined coal seam.

15. The process of claim 9 wherein the withdrawn product gas from said pyrolysis is utilized to preheat another retorting room in said coal deposit.

* * * * *